United States Patent [19]

Kronseder et al.

[11] 3,937,642

[45] Feb. 10, 1976

[54] LABELING DEVICE WITH AN INSTALLATION FOR MARKING LABELS

[75] Inventors: Hermann Kronseder, Neutraubling; Franz Wetter, Regensburg, both of Germany

[73] Assignee: Hermann Kronseder, Neutraubling, Germany

[22] Filed: Dec. 23, 1974

[21] Appl. No.: 535,320

Related U.S. Application Data

[60] Division of Ser. No. 381,184, July 20, 1973, Pat. No. 3,893,388, which is a continuation of Ser. No. 223,204, Feb. 3, 1972, abandoned.

[30] Foreign Application Priority Data

| | | |
|---|---|---|
| Feb. 20, 1971 | Germany | 2108256 |
| Apr. 24, 1971 | Germany | 2120241 |
| July 17, 1971 | Germany | 7127471 |

[52] U.S. Cl. ..... 156/384; 101/91; 101/110; 101/407 A; 101/409; 156/567; 156/568; 156/571

[51] Int. Cl.[2] ..... B41L 21/06

[58] Field of Search ..... 156/277, 384, 446, 447, 156/458, 468, 442, 488, 476, 519, 521, 556, 566, 567, 588, 560, 571, 578, DIG. 9, DIG. 10, DIG. 11, DIG. 12, DIG. 26, DIG. 47; 101/91, 110, 407, 408, 409

[56] References Cited

UNITED STATES PATENTS

| | | | |
|---|---|---|---|
| 2,177,578 | 10/1939 | Neidich | 101/132.5 |
| 2,398,646 | 4/1946 | Karbach et al. | 101/132 |
| 2,506,729 | 5/1950 | Morin | 101/110 |
| 2,683,409 | 7/1954 | Dutro et al. | 101/77 |
| 3,513,772 | 5/1970 | Brasty | 101/229 |
| 3,567,559 | 3/1971 | Dullinger | 156/571 |
| 3,611,921 | 10/1971 | Jahn | 101/77 |
| 3,654,861 | 4/1972 | Rudolph et al. | 101/409 |
| 3,748,210 | 7/1973 | Bentl | 156/571 |
| 3,796,154 | 3/1974 | Weisgerber | 101/409 |

*Primary Examiner*—Caleb Weston
*Attorney, Agent, or Firm*—Joseph P. House, Jr.

[57] ABSTRACT

A label applying turret having label support pads, a label marker and a pressing platen for pressing the label against the marker. The marker is mounted on the turret to rotate therewith and faces outwardly against the inwardly facing side of the label. In one embodiment a label gripping platen is aligned with the marker so that its action in gripping the label to the turret concurrently imposes die marking pressure on the label. In another embodiment a roller platen is mounted externally of the turret and presses the labels against the die marker.

6 Claims, 7 Drawing Figures

LABELING DEVICE WITH AN INSTALLATION FOR MARKING LABELS

This application is a division of copending application Ser. No. 381,184 filed July 20, 1973, now U.S. Pat. No. 3,893,388, which was a continuation of copending application Ser. No. 223,204 filed Feb. 3, 1972, now abandoned.

BACKGROUND OF THE INVENTION

Prior techniques have been suggested to press the label against the marker. One such device has the die marker separate from the label turret but provided with mechanism to move it in synchronism with the label turret and press the die marker against the label in the course of their co-joint movement. Such apparatus requires costly drive installation to synchronize the movement of the turret and the die marker. Moreover, the time span of pressure contact between the die marker and label is very short and the impression made by the marker on the label is not sufficiently permenent to withstand being wiped away or erased by the action of brushes, etc., typically used in labeling machines for pressing the labels onto containers.

Another prior proposal is to mount the die marker on radially movable slides which are pushed outwardly by a cam, first to pick up ink from an inking roller and then to press against the labels as they are transferred to the object which receives the label. This apparatus is subject to the complications of the cam installation for the slides which tend to cause maintenance problems. Moreover, where used in connection with labeled objects having flexible or irregular shapes, it is difficult to create a clean impression and this can be also wiped away by subsequent smoothing apparatus.

SUMMARY OF THE INVENTION

The present invention incorporates a series of die markers within the structure of the label turret, one for each label support pad, and facing outwardly substantially flush with the label supporting surfaces of the pads. Platen mechanism is provided to press the respective labels against the respective die markers, thus to enhance the marking of the label to the extent that it will not be wiped out, erased or obscured by the action of brushes, etc.

In one embodiment the platens are provided by the same gripping fingers which grip the label to the turret. The fingers are aligned with the die markers so that the pressure of the fingers concurrently grips the label to the turret and imposes marking pressure thereon.

In another embodiment a roller platen is mounted beyond the periphery of the turret and has a resilient pad surface which presses the label against the die marker as the label rotates.

It is advantageous, according to the present invention, that the die markers have stamp dies disposed substantially in the plane of the label pad support surface so that the label will remain substantially in its support plane without substantial deformation therefrom, even during the impression of the marking thereon. The apparatus of the present invention will limit local deformation of the label to 1 millimeter.

In the embodiment utilizing the roller platen, the roll is adjustable toward and away from the path of the die markers, thus enabling adjustment in the platen pressure against the label and marker for various effects, including the use of a stencil type die on the marker to cut through the label.

A further variation is contemplated in which an inking roll is mounted adjacent the turret path to apply ink to the die stamps as they pass the roll. The inking roller is mounted on a swing frame which can be swung out of the way of the labels. The ink roller is desirably swung away from the turret in the event of a missing label, thus to avoid applying an excess of ink to the die stamp. This mechanism may be responsive to a conventional sensing feeler which detects missing containers and concurrently blocks the extraction of labels from the magazine.

An important advantage of utilizing the gripping fingers to concurrently press the labels against the die stamps is to greatly lengthen the period of time in which marking pressure is exerted. This permits such enhancement of the impression made on the label that a coining die can be used, thus eliminating the need for an inking device.

The apparatus of the present invention does not require the use of actuating and control mechanism inside the label turret. The enhancement of marking pressure on the labels makes the use of coining die stamps effective on a wide variety of label substrates, including coated and high brilliant paper, metal foil, etc.

Other objects, features and advantages of the invention will appear from the following disclosure.

DESCRIPTION OF THE PREFERRED EMBODIMENTS

Figure 1:
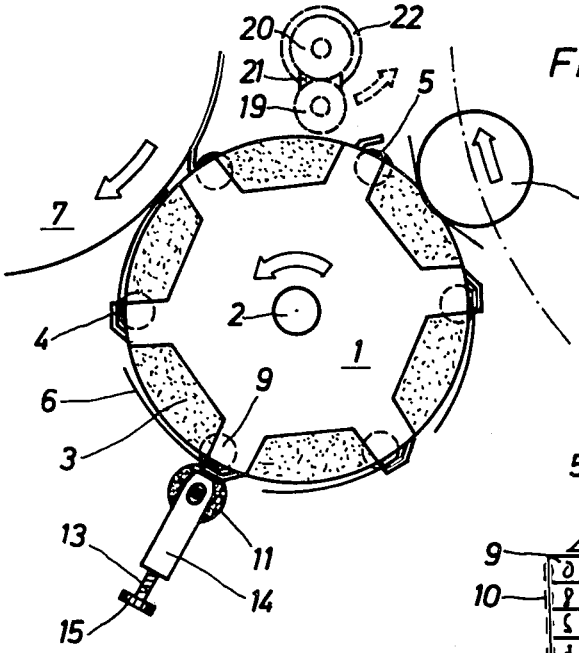
FIG. 1 is a diagrammatic plan view of a labeling turret and associated apparatus embodying the invention.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Like parts are identified by the same reference characters in the several views.

Figure 2:
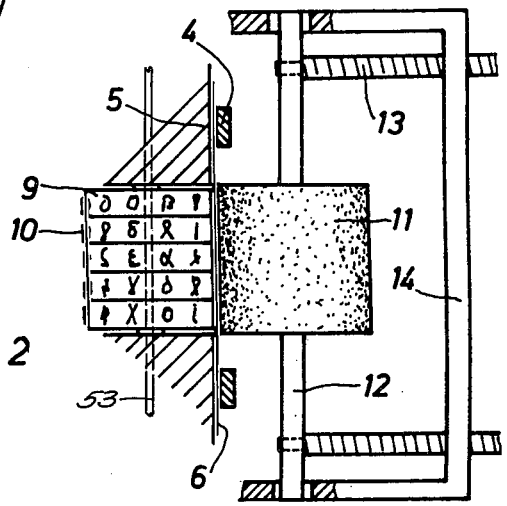
FIG. 2 is a fragmentary diagrammatic side view showing die stamps made up of a stack of rotary disks, the pressing mechanism comprising a counter roller platen mounted externally of the turret.
Figure 3:
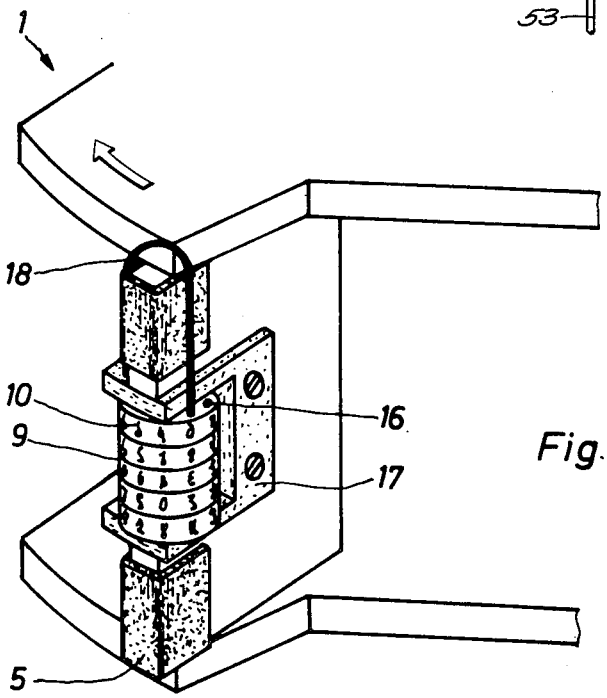
FIG. 3 is a fragmentary perspective view of a portion of the turret and showing the installation of a die marker made up of multiple rotatable disks.

FIGS. 1–3 show one embodiment of the invention in which the labeling turret or cylinder 1 is driven by shaft 2 in the direction of the arrow. Turret 1 includes a series of peripherally mounted sponge pads or pallets 3.

The turret is also provided with grip means to hold labels on the pads, as the turret rotates. In the disclosed embodiments, the grip means comprises gripping fingers 4. At the forward edge of each pad 3 are located paired cam controlled gripper fingers 4 backed by resilient surfaced supports 5, similar to corresponding parts shown in the embodiment of FIG. 4.

Turret 1 picks labels 6 from the glued adhesion surfaces of the extraction cylinder 7 which is driven in the direction of the arrow and transfers the labels ultimately to objects to be labeled, such as the container 8, at which point the gripper fingers 4 release the label and the label is adhered to the container, as is also disclosed in U.S. Pat. Nos. 3,546,047; 3,567,559; 3,567,551 and 3,586,580.

In the embodiment of the invention shown in FIGS. 1–3, die markers are provided in the form of an array of vertically stacked rotating die marker disks 9. These are mounted at the leading edge of each pad 3. The disks 9 bear peripheral die stamps 10 and the disks 9 are rotatable about a central axle shaft 53 so as to permit changing the stamp 10 which is to be marked on the label. The stamps 10 can constitute inked, coined or cutting dies.

The outer periphery of the respective disks 9 lie in a vertical plane with the label bearing or support faces of supports 5. In the embodiment shown in FIG. 3, the disks 9 are mounted in a bracket 17, removably attached to the support 5 by screws or the like.

As indicated in FIG. 1, labels 6 held by the gripper fingers 4 on the circumference of the turret 1 will be transported past a stationary counter roller platen 11 which is provided with a resilient surface and which is positioned on its stationary mounting bracket 14 in such a way that it projects slightly into the path of the orbiting labels. Accordingly, the counter roll 11 presses the label against the marker stamps as the label passes therebetween. The counter roll 11 may be freely rotatable on its vertical shaft 12 which is adjustably positioned on the bracket 14 by means of the screws 13 which are actuated manually by the thumb nuts 15. Roller platen 11 may also be rotatably driven in synchronism with the turret 1 by means of a belt or other drive from the driving shaft 2 to the roller platen shaft 12.

As shown in FIG. 3, the respective disks 9 are desirably provided with a series of holes 16, one adjacent each die stamp 10. A U-shaped, two-legged locking pin 18 is provided. By inserting the legs of the staple-shaped locking pin through aligned corresponding holes 16, the respective disks 9 can be locked in any selected position. By removing the U-shaped pin 18 the respective disks 9 may be individually or collectively rotated to different positions and relocked, thus to change the marking upon the label. If desired, the entire marker assembly can be removed by loosening the screws and removing the bracket 17 from the assembly.

In the case of inked die stamps 10, an ink roller 19 can be provided, in connection with an ink string roller 20, the two being interconnected by a swing lever 21 by which the ink roller 19 can be swung in the direction of the arrow. The purpose of the ink roller 19 is to apply a coating of ink to the ink type die stamps 10 as the marker passes the ink roller 19. A turning magnet 22 can be provided to control the swinging motion of the ink roller 19. If desired, the turning magnet can be actuated by a suitable known device which will swing the roller 19 away from the path of the marker in the absence of a corresponding label in the extraction cylinder 7. Magnet 22 can also be arranged to be actuated to swing the roller 19 away in the event the stamps 10 constitute coining or cutting dies. While the ink roller 19 is ordinarily freely rotatable, it can be driven by connecting it to the shaft 2 with a belt or the like.

Figure 4:
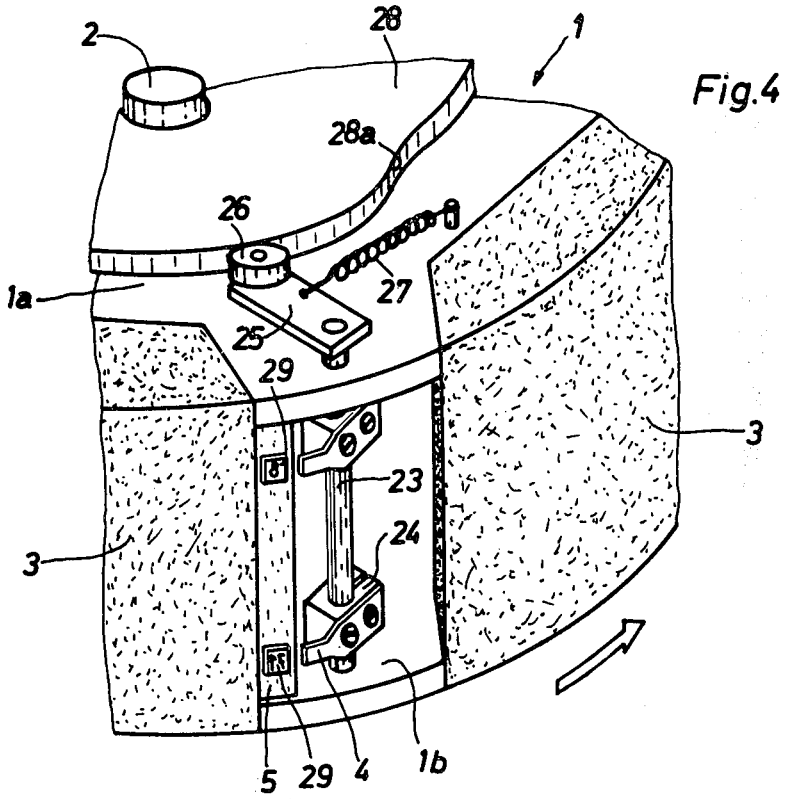
FIG. 4 is a fragmentary perspective view of an embodiment of a label turret incorporating label grippers which concurrently function as pressing platens.

FIG. 4 shows a modified embodiment and also shows further details of the labeling turret which comprises a cover plate 1a and a base or ground plate 1b, both connected to the shaft 2. Support 5 extends between the plates 1a, 1b, as do the sponge pads 3. The gripper fingers 4 are typically swingably mounted on a gripper shaft 23 to which gripper blocks 24 are adjustably clamped. On the upper end of the gripper shaft 23 is a swing crank or lever 25 carrying a cam follower roller 26 at its end. Tension spring 27 urges the roller 26 against the stationary control cam 28.

In this embodiment the marker comprises die slugs 29 seated in the supports 5 and which carry on their exposed faces selected die stamps.

As the turret 1 rotates in the direction of the arrow, cam roller 26 is swung outwardly by the cam 28, thus to open the fingers 4. Labels 6 from the extraction cylinder 7 are transferred over to the turret 1 at which time the cam follower roller 26 follows along the incline of slope 28a and the gripper fingers 4 close to clamp the leading edge of the label against the die stamps 29. The gripper fingers 4 are aligned to close on the stamps 29 and function also as pressing platens which concurrently grip the label to the turret and exert stamping pressure on the label against the stamps 29. In this embodiment the stamping pressure is maintained during the relatively long arc of movement of the turret from the point where the gripper fingers close on the label to the point where the gripper fingers are opened in the course of transferring the label to the container 8. Accordingly, there is a relatively long period of time during which stamping pressure is applied to the label.

Figure 5:
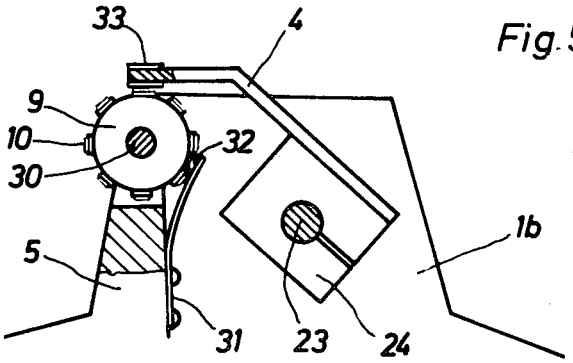
FIG. 5 is a fragmentary diagrammatic view of an embodiment showing a construction similar to that in FIG. 4, but in which the die stamps are rotatable to expose different die type thereon.

FIG. 5 illustrates another embodiment which incorporates features of FIG. 4, in which the gripper fingers function as platens, and in which the die marker stamps 10 are formed on the edge of a rotary disk 9, so as to permit easy change of the specific die stamp. There is an upper and lower disk 9 corresponding in position to the stamp dies 29 of FIG. 4, each being mounted on a central shaft 30. A leaf spring 31 carries a brake button 32 which seats between adjacent stamps 10, thus to adjustably fix the disk 9 in a position with a selected die stamp 10 facing outwardly. The disks 9 can be turned by hand and the braking button 32 will lift or ratchet over the stamp dies 10 to permit the adjustment. Gripper finger 4 may be provided with a resilient pad 33 to facilitate pressing the label against the stamp.

While in FIG. 5 the axis of shaft 30 is parallel to drive shaft 2, other arrangements are possible. For example, shaft 30 could be horizontal and tangent to a circle drawn about shaft 2.

Figure 6:
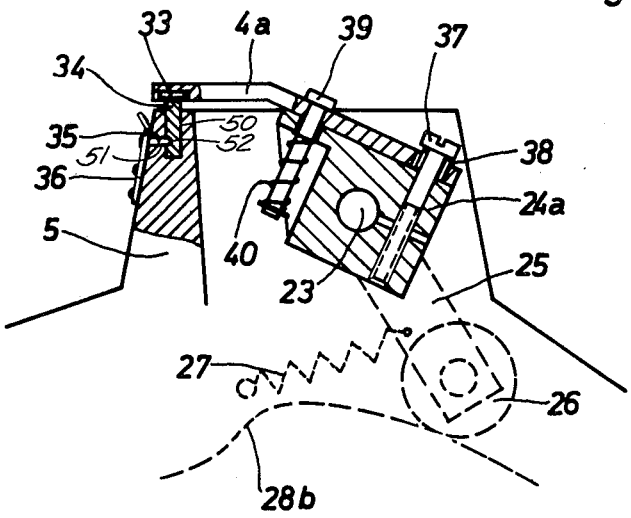
FIG. 6 is a fragmentary diagrammatic view of an embodiment similar to FIG. 5, but showing a different form of die stamp and resiliently mounted gripper fingers.

FIG. 6 is a further embodiment of the invention in which the marker consists of a die slug 34 removably seated in a socket recess 50 in the support 5. Slug 34 is releasably locked in place by a pin 35 movable through a transverse bore 51 in support 5 and into locking detent engagement with a groove 52 in the slug 34. Pin 35 is desirably mounted on a leaf spring 36 by which it can be retracted to permit removal of the slug 34 from its seat.

In FIG. 6 the gripper finger 4a is mounted resiliently on the gripper block 24a which is fixedly mounted on the shaft 23. In this embodiment the arm of the finger 4*a* is mounted at its rear end to the block 24*a* by a headed bolt 37 which bears on a resilient bushing 38 which seats into an over-size hole in the rear end of the arm of gripper finger 4*a*. Spaced from bolt 37 the arm of gripper finger 4a is engaged by a headed bolt 39 which extends through a ledge on the front end of the gripper block 24*a* and has coiled thereabout a coil spring 40 which seats on the undersurface of the ledge. Accordingly, spring 40 is exerted to resiliently press the finger 4*a* against the stamp 34 in order to obtain a yieldable but high pressure closure, both for gripping and enhancement of the stamped impression on the label. As in the embodiment of FIG. 5, fingers 4*a* may be provided with a resilient pad 33 at its end which closes on the label.

The shaft 23 of the FIG. 6 embodiment is provided with a crank arm or lever 25 with a cam roller 26 movable along the stationary cam 28*b*. This device makes possible a powerful stamping effect. Any inaccuracies or machine tolerances will be compensated for by the yieldability built into the various parts.

Figure 7:
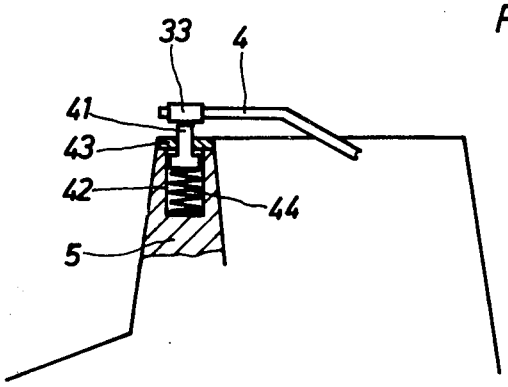
FIG. 7 is a diagrammatic view of an embodiment showing the mounting of a spring-biased die stamp.

FIG. 7 shows a still further embodiment in which the stamp die 41 is received in a socket 42 in the support 5 which has a coil spring 44 biased to project the stamp 41 to its outermost position. Socket 42 is closed by plate 43. The gripper finger 4 with its elastic pad 33 will act upon the stamp 41 to resiliently compress the spring 44 and thus exert substantial pressure between the stamp and the fingers.

We claim:

1. In a label applying turret for picking labels from an extraction cylinder at one side of the turret and transferring the labels to objects to be labeled at another side of the turret, said turret having a series of outwardly facing label transfer and support pads and grip means to hold labels on the pads as the turret rotates between the extraction cylinder and the objects to be labeled, the improvement comprising a corresponding series of outwardly facing label markers mounted on the turret adjacent to and substantially flush with said pads, each label marker being associated with a corresponding pad whereby respective labels gripped by the grip means and carried by said pads also lie against associated adjacent markers, and inwardly pressing means for pressing the labels against the markers to cause marked impressions on the labels in the course of transfer of the labels from the extraction cylinder to the objects to be labeled, said pressing means and grip means together comprising a corresponding series of label gripping fingers aligned with the markers and means for biasing the fingers toward the markers whereby the fingers concurrently grip the labels and press them against the markers.

2. The turret of claim 1 in which the means biasing the fingers toward the markers comprises a cam, a series of shafts on which the fingers are mounted and a cam follower mounted on each shaft.

3. The turret of claim 1 in which the label gripping fingers have resilient pads facing the markers.

4. The turret of claim 1 in which the label gripping fingers have yieldable actuating means.

5. The turret of claim 1 in which the markers comprise die slugs, said turret having sockets in which said slugs are removably seated.

6. The turret of claim 5 in which said sockets have spring means against which said slugs seat.

* * * * *